US005235649A

United States Patent [19]

Reda

[11] Patent Number: 5,235,649

[45] Date of Patent: Aug. 10, 1993

[54] CIGARETTE INSPECTION METHOD

[75] Inventor: James R. Reda, Rochester, N.Y.

[73] Assignee: Videk Corporation, Canandaigua, N.Y.

[21] Appl. No.: 714,538

[22] Filed: Jun. 13, 1991

[51] Int. Cl.[5] ..... G06K 9/00

[52] U.S. Cl. ..... 382/1; 382/18; 358/106; 356/237; 209/536

[58] Field of Search ..... 382/1, 8, 18; 358/106, 358/107; 356/237; 250/223 R; 209/536, 535

[56] References Cited

U.S. PATENT DOCUMENTS

| | | | |
|---|---|---|---|
| 3,729,636 | 4/1973 | Merker | 250/223 R |
| 3,980,567 | 9/1976 | Benini | 250/223 |
| 4,266,674 | 5/1981 | Bell et al. | 209/536 |
| 4,486,098 | 12/1984 | Buchegger et al. | 209/536 |
| 4,638,371 | 1/1987 | Milch | 358/293 |
| 4,639,769 | 1/1987 | Fleisher et al. | 358/27 |
| 4,644,150 | 2/1987 | Kuga et al. | 209/536 |
| 4,908,518 | 3/1990 | Losee et al. | 358/213.23 |
| 4,969,746 | 11/1990 | McConnell et al. | 358/106 |
| 4,976,544 | 12/1990 | Neri | 358/106 |
| 5,127,737 | 7/1992 | Neri | 356/237 |

*Primary Examiner*—David K. Moore
*Assistant Examiner*—David Fox
*Attorney, Agent, or Firm*—Cumpston & Shaw

[57] ABSTRACT

Method for determining when a cigarette in a bundle is unsuitable which uses a statistical value based on gray scales.

4 Claims, 2 Drawing Sheets

CIGARETTE INSPECTION METHOD

FIELD OF THE INVENTION

The present invention relates to a method for inspecting cigarettes and, more particularly, to a method to determine whether cigarettes in a bundle are improperly filled or have an incorrect length.

BACKGROUND OF THE INVENTION

It is well-known to inspect cigarettes prior to packaging for purposes of detecting if there is an inadequate loose charge of tobacco near the end or if a cigarette in a bundle is broken or if it is a "short-stick" (improper length). Such an inspection is highly desirable from the standpoint that a consumer is annoyed and risks injury if the cigarette is improperly filled. Inspection is also necessary to determine that the consumer receives value for his money and does not receive a short or broken cigarette.

It is therefore desirable to reject cigarettes which do not meet proper specifications so as to maintain high speed production while at the same time providing customer satisfaction.

One known technique for detecting missing and improperly filled cigarettes is mechanical inspection. Mechanical inspection employs pins which are pushed against the end portion of cigarettes. The extent to which a pin penetrates indicates the amount of tobacco shreds in the end portion of a cigarette. However, mechanical inspection is undesirable because of speed limitations. Further, it is very difficult to mechanically inspect whether or not a cigarette in a bundle is broken and to provide inspection techniques to determine if cigarettes are of incorrect length.

Optical techniques are known for detecting missing and improperly filled cigarettes. See, for example, U.S. Pat. Nos. 4,266,674 and 3,980,567. In these types of systems a light producing source illuminates the end portions of a bundle of cigarettes and a transducer is used for sensing reflected light from the end portions to determine whether or not the end portions are properly filled with tobacco. However, in prior art inspection systems they have been found subject to inaccuracies.

U.S. Pat. No. 4,266,674 discloses a photodetector apparatus used to detect missing and improperly filled cigarettes. However,its speed is limited due to its sequential circuitry.

SUMMARY OF THE INVENTION

It is therefore an object of this invention to provide a highly reliable high-speed method of determining a cigarette in a bundle is improperly filled, broken or is a short stick.

This object is achieved in a method for determining when a cigarette in a bundle is improperly filled or an incorrect length (viz. broken or is a short stick), comprising the steps of:

(a) illuminating the ends of a bundle of cigarettes;

(b) receiving light by an electronic camera or the like reflected by the end portions of each cigarette;

(c) defining a predetermined position for locating each cigarette, each such position having a predetermined number of CCD pixels;

(d) recording the intensity of light corresponding to each such pixel;

(e) constructing a histogram based upon the intensity of reflected light for the pixels corresponding to each cigarette of the bundle, wherein the histogram is a frequency of occurrence of gray scales;

(f) calculating a statistical value based on the gray levels; and (g) comparing the calculated statistic values with predetermined reference value to determine if the cigarette is improperly filled, broken or is a short stick.

The present invention offers the following advantages over the prior art. It facilitates increased speeds since it provides simultaneous acquisition of reflected light from the entire bundle of cigarette ends. The present invention also has improved accuracy since each cigarette end is illuminated by a plurality of fiber optics and received by a plurality of pixels. Moreover, since the present invention can operate in the digital domain, it can readily use statistics to differentiate between different cigarette defects.

DESCRIPTION OF THE PREFERRED EMBODIMENT

Figures 1, 3:
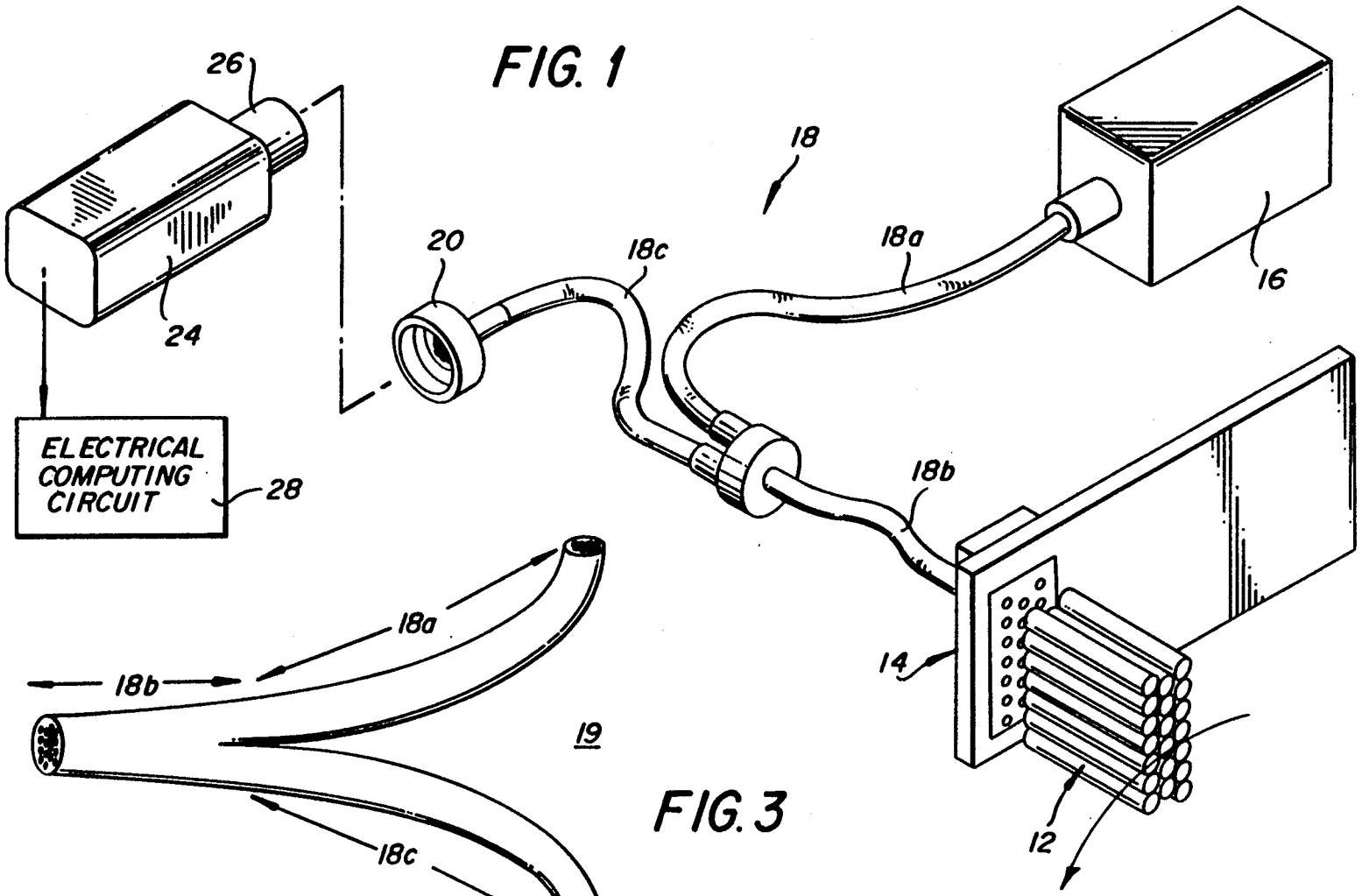
FIG. 1 is a schematic of cigarette inspection apparatus in accordance with the invention.
FIG. 3 shows one channel of the multifiberoptic transmission cable of FIG. 1.

FIG. 1 illustrates an inspection apparatus 10 at which a bundle of cigarettes 12 has been moved in the direction of an arrow to a position where its end portions are aligned with an optical mounting plate 14. Light from a source 16 is conducted by optical fiber transmission cable 18 to the fiber optic mounting plate 14. The transmission cable 18 includes transmission section **18*a*, transceiver section 18*b*, and receiver section 18*c***.

The cigarette bundle 12 has been secured by supporting means (not shown) and is movable along a path by means (not shown) to be aligned with the optical mounting plate 14. The light source 16 is preferably a xenon strobe type light which provides a high-speed, high-intensity pulse of light which is conducted by optical transmission section **18*a* to the transceiver section 18*b* to a fiber mounting plate 14. The transceiver section 18*b* actually includes 40 channels corresponding to sections 18*a* and 18*c*, each of which contains 20 channels. Each channel includes a plurality of fiber optics as will be explained when FIG. 3 is discussed. Light which is reflected from the end portions of each cigarette is conducted through the transceiving section 18*b* to receiving section 18*c* and to optical coupling illuminate fixture 20. Light from the coupling illuminates a CCD electronic camera 24 by way of a lens system 26. Lens system 26** can be a simple camera lens which is designed to focus light from the optical coupling fixture onto the electronic camera.

Turning now to FIG. 3 where one channel of the optical fiber transmission cable is shown in more detail Section **18*a* includes a plurality of conventional fiber optics, each of which continues through section 18*b* to the mounting plate 14, a plurality of fiber optics conduct light through section 18*c* to the optical coupling fixture 20. Light is simultaneously reflected from each cigarette end and is passed through transceiver section 18*b* through receiver section 18*c* to the optical coupling fixture 20, where it is delivered to the camera 24 and illuminates a CCD chip in camera 24**. For an example of such a chip, see U.S. Pat. No. 4,908,518 to Losee et al and U.S. Pat. No. 4,638,371 to Milch.

Figure 2:
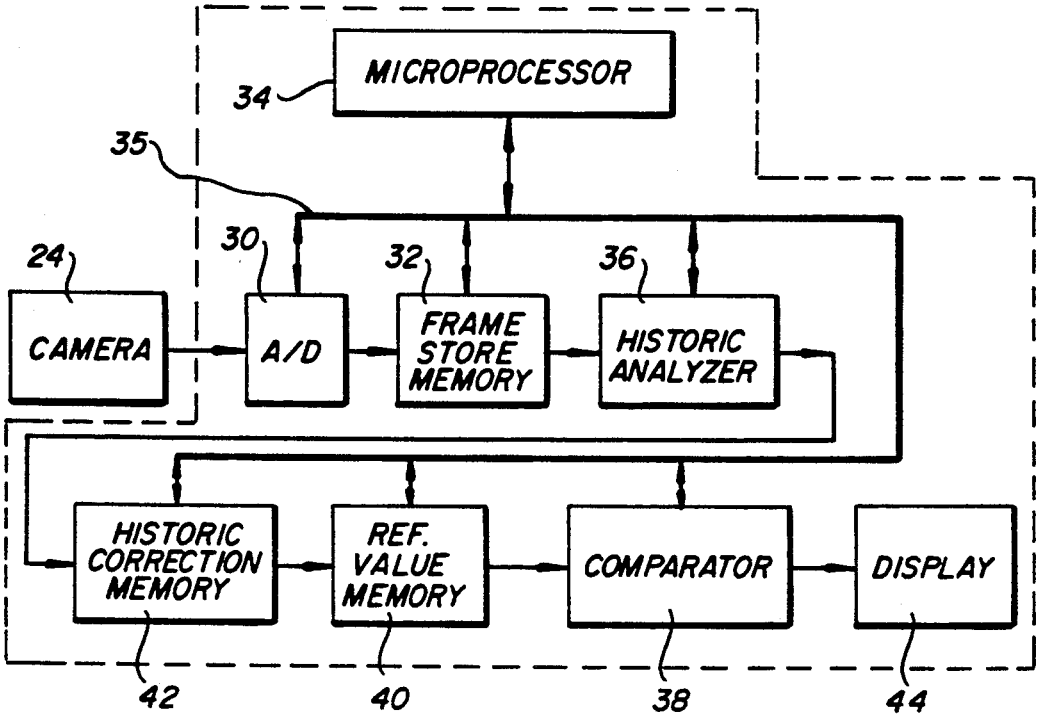
FIG. 2 is a block diagram of the electrical computing circuit shown in FIG. 1.

In FIG. 2, the electrical computing circuit 20 is shown in more detail. The electronic camera stores a plurality of CCD pixels corresponding to each cigarette. For a specific example, there can be 400 pixels for each cigarette with each pixel being illuminated by light from 100 fiber optics in one of the channels.

Figure 4:
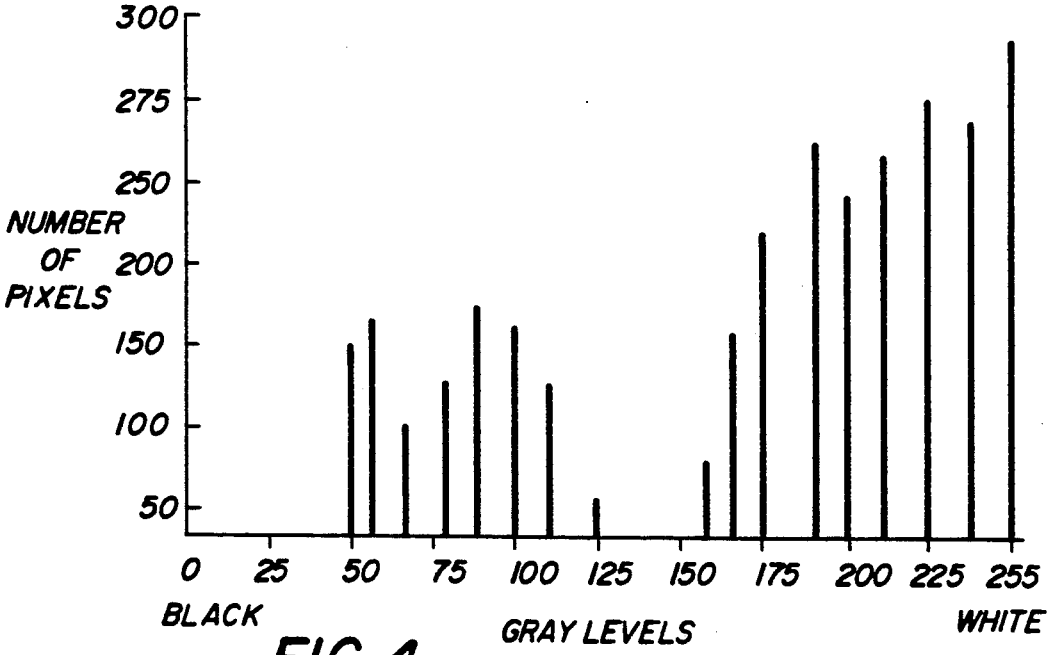
FIG. 4 is a histogram embodied in the histogram in the histogram analyzer of FIG. 1.

The construction of CCD cameras is well understood to those skilled in the art. At the output of camera 24 is a sequential series of analog signals corresponding to each pixel. An analog to digital converter 30 receives each analog receiver signal, digitizes it and then delivers it to a frame store memory 32. The light coupling 20 is located in a predetermined position so that light from the ends of cigarettes in bundle illuminates CCD pixels corresponding to each cigarette. Turning to FIG. 2, a microprocessor 34 is in control of all of the operations of electronic computing circuitry 20 via a bus type arrangement 35. After a frame (all the pixels corresponding to a bundle of cigarettes) has been stored in frame store 32, the microprocessor 34 delivers such information to a histogram analyzer 36 which computes the histogram (see FIG. 4).

The histogram includes the number of pixels which have a particular gray scale (Y axis) and this number is plotted verses the number of gray scales, which in this case is 256. In other words, the gray scale is from 0–255. If a pixel is black , it will have a scale of "0". If it has a gray scale of 255, it of course has the highest luminescence. The construction of this type of histogram is well understood, see commonly assigned U.S. Pat. No. 4,639,769 to Fleisher et al, the disclosure of which is incorporated by reference herein. The microprocessor 34, based upon the computed histogram, now calculates the arithmetic mean and the standard deviation of the gray scales.

The following equations can be used to calculate standard deviation and arithmetic mean:

$$\bar{X} = \frac{\sum_{l=0}^{255} (l \times n_l)}{N} \quad (1)$$

wherein:

$\bar{X}$—The arithmetic mean or average pixel gray level within the analysis region.

l—Gray level (0 being completely black / 255 being completely white)

$n_l$—The number of pixels at gray level l

N—Total number of pixels within the analysis region $$STD = \sqrt{\frac{\sum_{l=0}^{255} (\bar{X} - (l \times (n_l/N)))^2}{N-1}} \quad (2)$$

wherein:

STD—The standard deviation of the gray scales of the pixels within the analysis region $\bar{X}$—The average pixel gray level within the analysis region.

l—Gray level (0 being completely black / 255 being completely white)

$n_l$—The number of pixels at gray level l

N—Total number of pixels within the analysis region

A comparator 38 compares the arithmetic mean and the standard deviation with digital reference levels, previously stored in reference memory 40. In accordance with this invention, it has been determined that there is a correlation between standard deviation and whether a cigarette is loosely filled. If a cigarette is loosely filled, then it will have a standard deviation higher than some predetermined reference level. In such a case the computer 34 will provide the reference level and the computed level to a comparator 38. The comparator 38 will signal a display that there is a loosely filled cigarette and the bundle will be rejected. A short stick (a cigarette shorter than desired) is calculated in the following manner: a short stick is characterized by an arithmetic mean that is lower than that determined for a proper length cigarette. There is a direct correlation between the length of a cigarette and its arithmetic mean. When a cigarette is too short the microprocessor 34 will cause the comparator 38 to compare the arithmetic mean with a reference level and the comparator will signal to the display to record a defect and reject the bundle.

Turning again to FIG. 2, we see there is a historical correction memory 42. The purpose of this memory will now be explained. It is used to correct for the gradual deterioration of light produced by source 16 (see FIG. 1). Without correction, as the intensity of light from source 16 increases, the histogram of FIG. 4 will actually shift to the left. Eventually, the arithmetic mean will be significantly reduced. In order to normalize this reduction, the system keeps a record of computed acceptable arithmetic means. Based upon these computed values, over time it re-computes reference and standard deviations.

The invention has been described in detail with particular reference to certain preferred embodiments thereof, but it will be understood that variations and modifications can be effected within the spirit and scope of the invention.

What is claimed is:

1. A method for determining when a cigarette in a bundle is improperly filled (broken or is a short stick)k, comprising the steps of:

(a) illuminating the ends of a bundle of cigarettes by light from a source;

(b) receiving light by a CCD camera or the like reflected by the end portions of each cigarette;

(c) defining a predetermined position for locating each cigarette, each such position having a predetermined number of CCD pixels;

(d) recording the intensity of light corresponding to each such pixel;

(e) constructing a histogram based upon the intensity of reflected light for the pixels corresponding to each cigarette of the bundle, wherein the histogram is a frequency of occurrence of gray scales;

(f) calculating arithmetic mean and standard deviation statistical values based on the gray scales; and (g) comparing the calculated, arithmetic mean statistic value with first predetermined reference value to determine if the cigarette is an incorrect length and the standard deviation with a second reference value to determine if a cigarette is too loosely filled.

2. The method of claim 1 including adjusting the first and second reference values based upon the intensity of light produced by the light source.

3. A method for determining when a cigarette in a bundle is unsuitable, comprising the steps of:

(a) illuminating the ends of a bundle of cigarettes;

(b) receiving light by a CCD camera or the like reflected by the end portions of each cigarette;

(c) defining a predetermined position for locating each cigarette, each such position having a predetermined number of CCD pixels;

(d) recording the intensity of light corresponding to each such pixel;

(e) constructing a histogram based upon the intensity of reflected light for the pixels corresponding to each cigarette of the bundle, wherein the histogram is a frequency of occurrence of gray scales;

(f) calculating a standard deviation statistic value based on the gray scales; and (g) comparing the calculated standard deviation statistical value with a predetermined reference value to determine if a cigarette is too loosely filled.

4. A method for determining when a cigarette in a bundle is unsuitable, comprising the steps of:

(a) illuminating the ends of a bundle of cigarettes;

(b) receiving light by a CCD camera or the like reflected by the end portions of each cigarette;

(c) defining a predetermined position for locating each cigarette, each such position having a predetermined number of CCD pixels;

(d) recording the intensity of light corresponding to each such pixel;

(e) constructing a histogram based upon the intensity of reflected light for the pixels corresponding to each cigarette of the bundle, wherein the histogram is a frequency of occurrence of gray scales;

(f) calculating an arithmetic means statistic value based on the gray scales; and (g) comparing the calculated arithmetic mean statistical value with a predetermined reference value to determine if a cigarette is broken or a short stack.

* * * * *